US007753323B2

(12) United States Patent
Volk

(10) Patent No.: US 7,753,323 B2
(45) Date of Patent: Jul. 13, 2010

(54) V-LIFT

(76) Inventor: David Volk, P.O. Box 400, Bismarck, ND (US) 58502

( * ) Notice: Subject to any disclaimer, the term of this patent is extended or adjusted under 35 U.S.C. 154(b) by 201 days.

(21) Appl. No.: 11/708,332

(22) Filed: Feb. 21, 2007

(65) Prior Publication Data

US 2008/0200313 A1 Aug. 21, 2008

(51) Int. Cl.
*A47G 29/00* (2006.01)
*A47G 23/02* (2006.01)
*A45D 19/04* (2006.01)

(52) U.S. Cl. ..... 248/127; 14/71.3; 248/157; 248/370; 248/397; 254/3 C; 254/8 C; 254/124; 108/7

(58) Field of Classification Search ..... 248/370, 248/371, 394, 397, 398, 125.2, 130, 133, 248/138, 142, 292.11, 292.12, 127, 157, 248/423; 14/69.5, 71.3, 71.7, 72.5; 482/31, 482/32, 30; 254/3 R, 3 B, 3 C, 8 C, 8 R, 254/2 B, 2 C, 124; 108/7, 145–147
See application file for complete search history.

(56) References Cited

U.S. PATENT DOCUMENTS

| | | | | | |
|---|---|---|---|---|---|
| 4,998,718 | A * | 3/1991 | Arens | 482/30 |
| 5,205,010 | A * | 4/1993 | Hageman | 14/71.7 |
| 5,326,336 | A * | 7/1994 | Wemlinger | 482/30 |
| 5,601,014 | A * | 2/1997 | Stevens et al. | 108/7 |
| 5,765,797 | A * | 6/1998 | Greene et al. | 248/398 |
| 5,829,948 | A * | 11/1998 | Becklund | 414/607 |
| 2008/0200313 | A1 * | 8/2008 | Volk | 482/30 |

* cited by examiner

*Primary Examiner*—Amy J Sterling
*Assistant Examiner*—Tan Le

(57) ABSTRACT

A diving board lift assembly for lifting a diving board from a substantially horizontal diving position to a substantially upright position is provided. The diving board having a diving end and a hinged end with the hinged end hingedly connected to a diving board support member. To raise the diving board, an actuator is rotated in a clockwise direction which rotation causes a portion of the top assembly to the lift mechanism to make contact with and raise the diving board to a near vertical position. To lower the diving board to its original position, the actuator need simply be rotated in a counter-clockwise direction.

14 Claims, 5 Drawing Sheets

V-LIFT

BACKGROUND OF THE INVENTION

Field of the Invention

The present invention relates generally to a diving board lift and more particularly to a self-contained, manually operated, diving board lift which can be easily utilized to safely, simply and quickly raise a diving board so that the diving board does not create an obstruction or a safety concern during other swimming pool activities.

Diving board systems generally include a diving board having a diving end and a secured end with the diving board being hingedly fastened to an anchored support at the secured end. The diving end is preferably positioned adjacent the edge of or over a swimming pool. An intermediate support is placed beneath the diving board between the diving end and the anchored end to act as a fulcrum point thereby allowing vertical movement of the diving end. Such vertical movement allows the diver to "spring" into the air to attempt or complete the diver's dive.

Diving boards in many swimming pools are generally located at or near the deepest end of the swimming pool. In addition to recreational swimming, swimming pools are also used for, among other things, competitive swimming. The starting blocks for competitive swimming must, in accordance with rules adopted by local, state and/or other regulatory bodies, also be located near the edge of the deepest end of the swimming pool. Thus, the starting blocks are located in the same area as the spring board diving system. To position the starting blocks at the same end of the swimming pool as the diving board, the diving board must either be physically removed or the diving end of the diving board must be manually raised to a position which does not conflict with the positioning of the starting blocks.

Removing the diving board from its support requires extensive time and labor. Moreover, removal of the diving board can create safety risks while individuals attempt to lift the heavy diving board on a slippery surface. Once the diving board is removed, it must then be stored in a location where it will not create a hazard and will not be damaged. Thus, removal of the diving board is strenuous, physically difficult, and dangerous. Likewise, once the diving board has been removed, its storage on a floor or against a wall can create a dangerous tripping hazard resulting in potentially severe injuries.

To raise the diving board, a variety of implements have been tried with very little success. Sticks and other objects have been utilized to pry the diving board in an upright position. The obvious safety concerns to both the individual prying the diving board and those individuals in the vicinity of the pried up board do not make this a workable alternative.

Similarly, U.S. Pat. No. 5,326,336 to Wemlinger describes a diving board lift which is fixedly attached to and made a part of the anchored base of the diving board. In addition, the disclosed lift utilizes a hydraulic pump to raise and lower the lift. By attaching the lift to the anchored base of the diving board, the diving board warranty is deemed void, thereby leaving the diving board owner responsible for any and all problems relating to the diving board. The use of a hydraulic cylinder creates the risk of hydraulic fluid leaking or spilling onto the surface, thereby creating a risk of pool water contamination and the risk of slip and fall injuries.

SUMMARY OF THE INVENTION

In view of the foregoing disadvantages inherent in the known types of apparatus and methods for raising or removing a diving board now present in the prior art, the present invention provides a new self-contained, manually or automatically operated, diving board lift which quickly, easily and securely raises a diving board so as to allow the safe use of starting blocks located in front of or adjacent to the diving board.

The diving board lift according to the present invention comprises a base assembly securely attached to the flooring surface. A lifting platform with a first end which is rotatably attached to the base assembly and a second end which extends away from the base assembly through a lifting means to engage and raise the diving board. The lifting means utilized is a manually or automatically operated actuator which is rotatably attached to the base assembly and the lifting platform. By turning the crank of the manual actuator or activating the automatic actuator in a clockwise direction, the second end of the lifting platform comes into engagement with the diving board and raises the diving board to a near upright position. The second end of the lifting platform include a pair of rollers with each roller contacting and rolling along the underside of the diving board while the diving board is raised.

A primary object of the present invention is to provide a self-contained diving board lift for raising a diving board to avert obstruction of one or more starting blocks used in competitive swimming.

Another object of the present invention is to provide a manual or automatic operated diving board lift to avoid the possibility of hydraulic fluid from contaminating the pool water or surface surrounding the pool.

An additional object of the present invention is to provide a self-contained, manually or automatically operated diving board lift which is easily operated by a single individual.

A further object of the present invention is to provide a diving board lift which is securely attached to the flooring surface.

Another object of the present invention is to provide a diving board lift that is relatively inexpensive to manufacture and, therefore, inexpensive to the consumer.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

There has thus been outlined, rather broadly, the more important features of the present invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

DESCRIPTION OF THE PREFERRED EMBODIMENT

Figure 1:
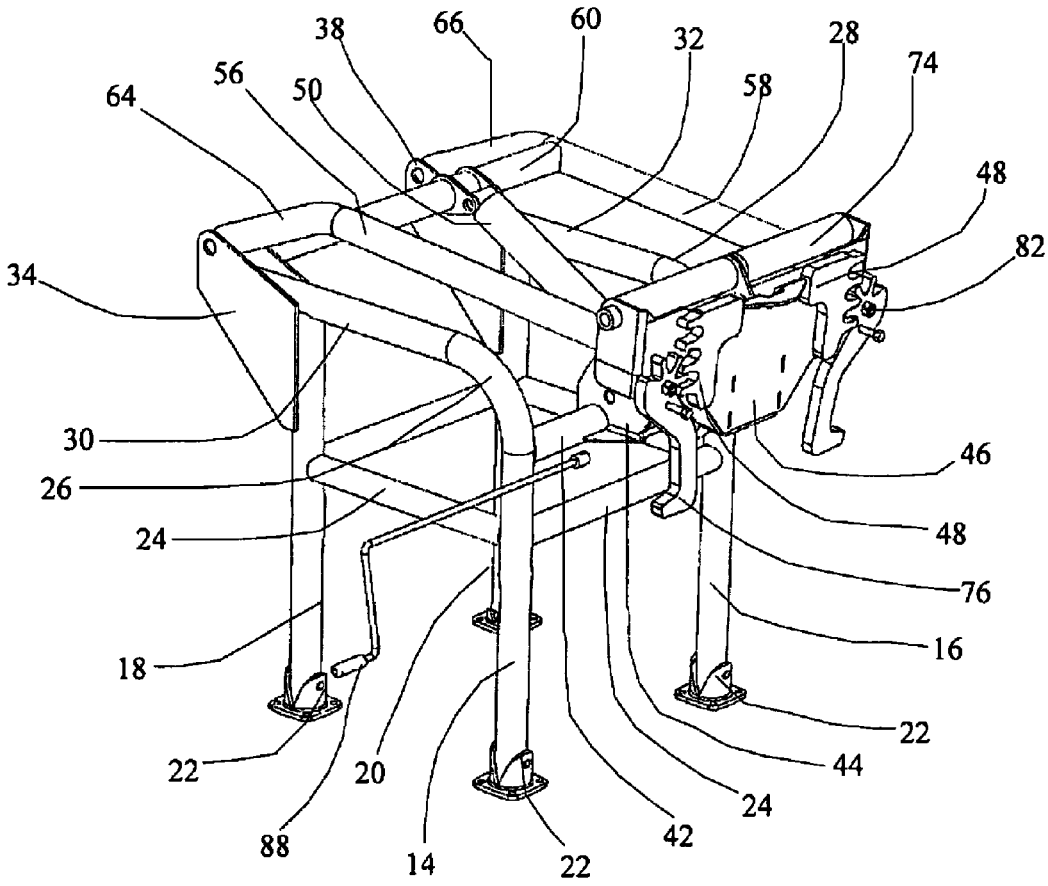
FIG. 1 is a perspective view of the diving board lift in a down position.

Turning now descriptively to the drawings, in which similar reference characters denote similar elements throughout the several views, illustrate a diving board lift, which is comprised of a base assembly, a lift assembly and a lifting means.

Base Assembly

Figure 3:
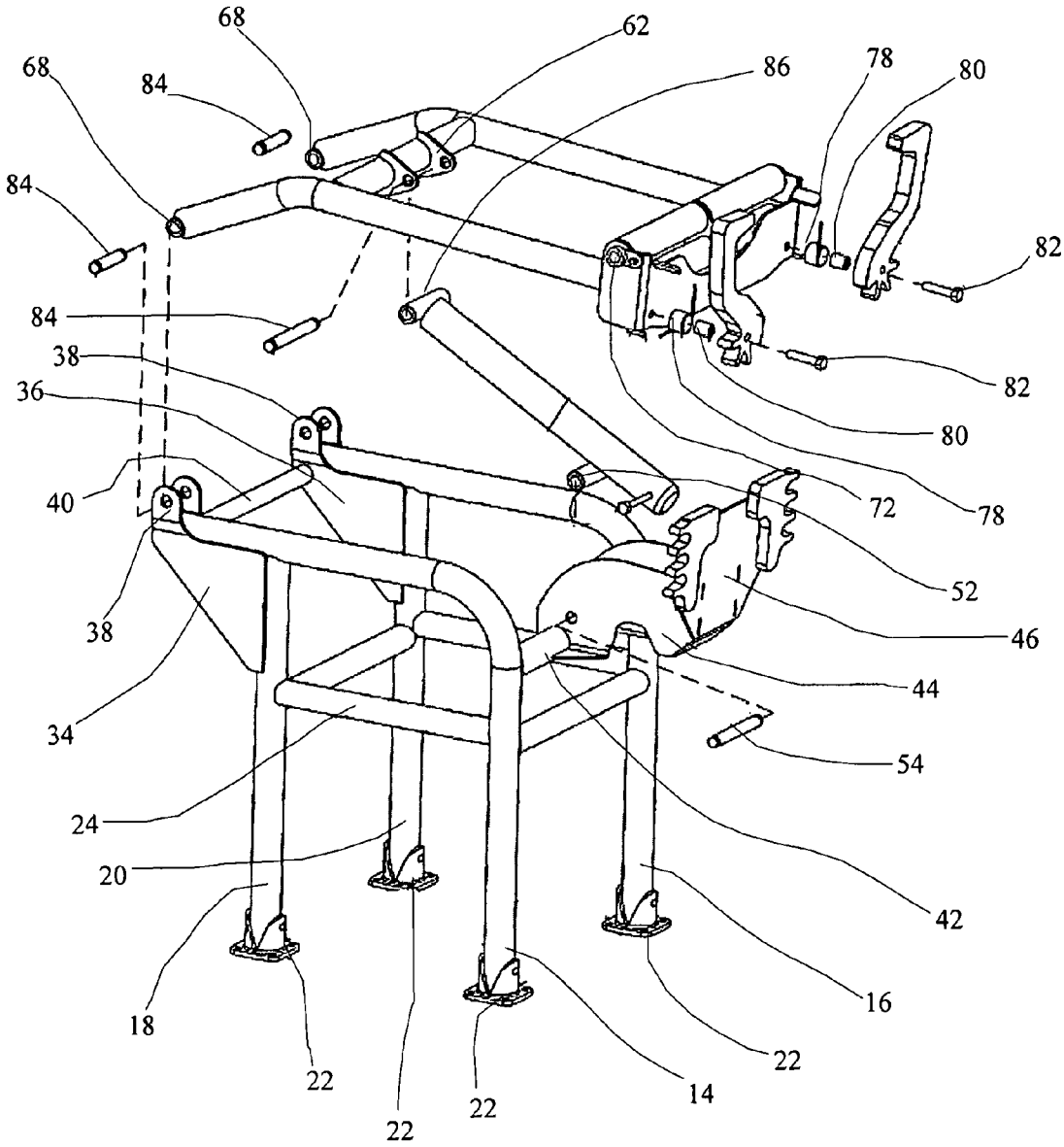
FIG. 3 is a perspective view of the top and base assemblies of the diving board lift.
Figure 4:
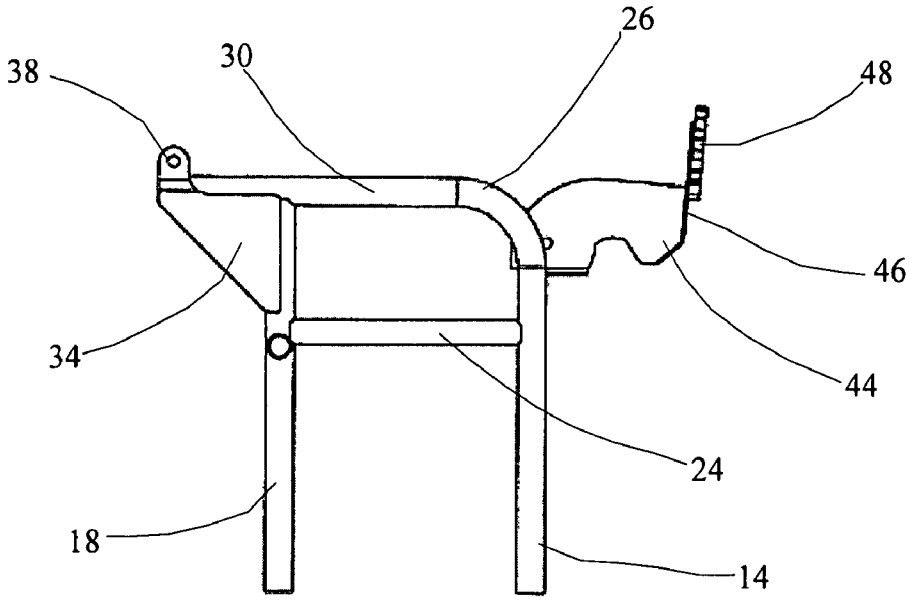
FIG. 4 is a side perspective view of the base assembly of the diving board lift.
Figure 5:
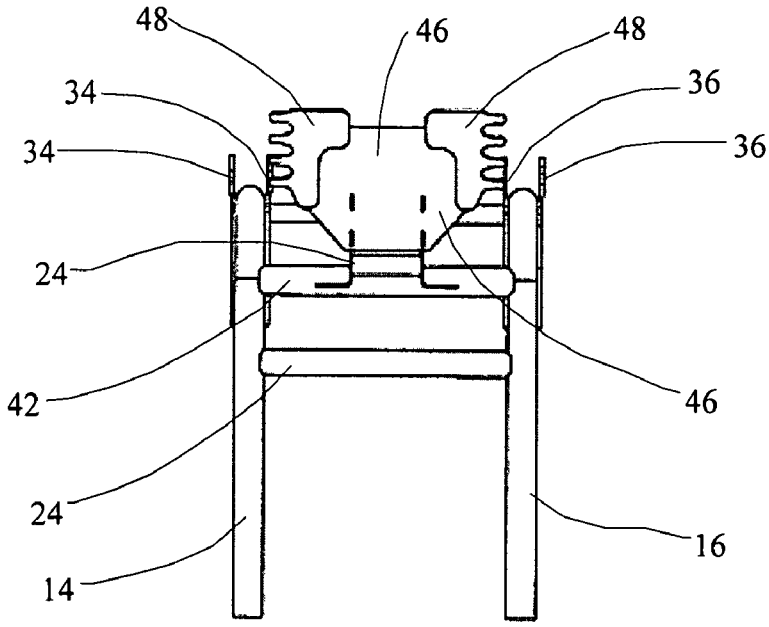
FIG. 5 is a front perspective view of the base assembly of the diving board lift.
Figure 6:
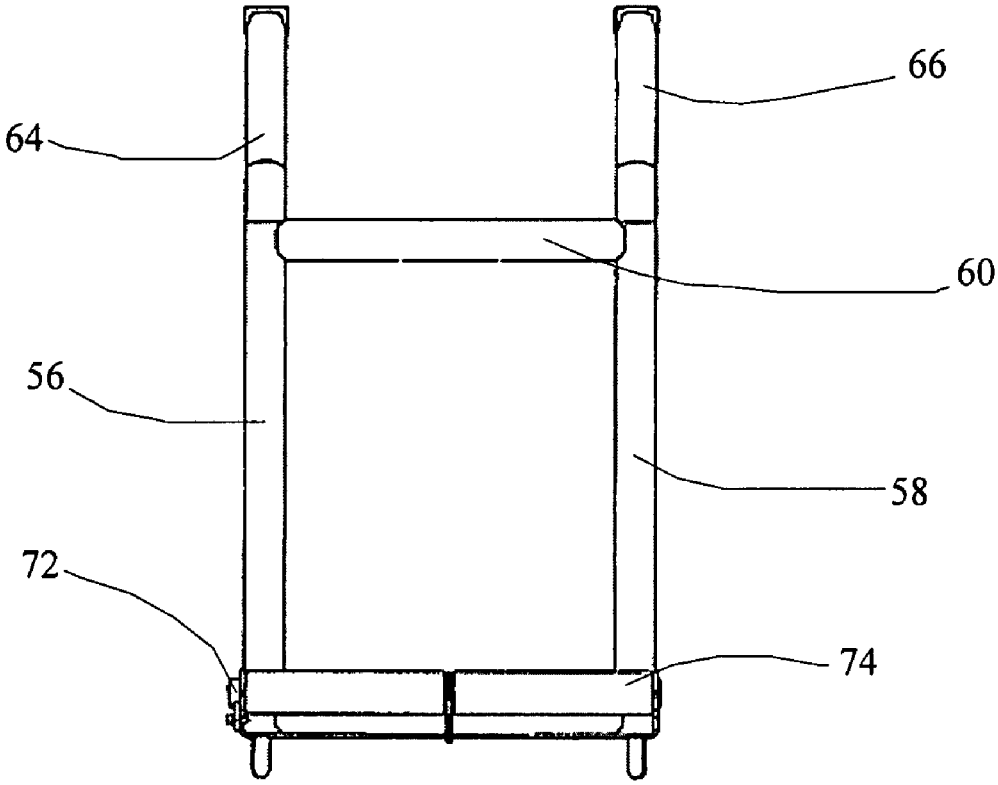
FIG. 6 is a top perspective view of the top assembly of the diving board lift.

Referring to FIGS. 1, 3, 4, 5 and 6, the base assembly is comprised of a first support post 14, a second support post 16, a third support post 18 and a fourth support post 20. The support posts 14, 16, 18, 20 extend vertically from the base castings 22 which are removably attached to the bottom end of the support posts 14, 16, 18, 20. Two parallel pairs of cross-bracing tubes 24 extend across and at right angles to the support posts 14, 16, 18, 20. The cross-bracing tubes 24 are permanently affixed at contact points on the support posts 14, 16, 18, 20.

Fixedly attached to the top end of the first support post 14 is the first end of the first inward-curved horizontal section of tubing 26. Fixedly attached to the top end of the second support post 16 is the first end of the second inward-curved horizontal section of tubing 28. The second end of the first inward-curved section of tubing 26 is fixedly attached to a first horizontal tubing section 30. The second end of the second inward-curved section of tubing 28 is fixedly attached to a second horizontal tubing section 32. The first horizontal tubing section 30 extends parallel to the cross-bracing tube 24 between the first and third support posts 14, 18 and across and beyond the top end of the third support post 18. The second horizontal tubing section 32 extends parallel to the cross-bracing tube 24 between the second and fourth support posts 16, 20 and across and beyond the top end of the fourth support post 20.

Fixedly attached to the sides of the third support post 18 and the first horizontal tubing section 30 is a first pair of triangular plates 34. Attached to the top edges of the first pair of triangular plates 34 is a flange 38 having a circular opening. The flange 38 extends above the top side of the first horizontal tubing section 30. Attached to the sides of the fourth support post 20 and the second horizontal tubing section 32 is a second pair of triangular plates 36. Attached to the top edges of the second pair of triangular plates 36 is a flange 38 having a circular opening. The flange 38 extends above the top side of the second horizontal tubing section 32. A plate-bracing tube 40 extends across and at right angles to the inside plates of the first and second pairs of triangular plates 34, 36. The plate-bracing tube 40 is permanently affixed at contact points on the first and second pair of triangular plates 34, 36.

Above and parallel to the cross-bracing tube 24 maintained between the first support post 14 and the second support post 16 is a support tube 42. The support tube 42 is permanently affixed at contact points on the first and second support posts 14, 16. Fixedly attached and at right angles to the support tube 42 are a pair of support plates 44. The support plates 44 are semi-rectangular with a top side, a bottom side, a front end and a back end. The support plates 44 are fixedly attached to the support tube 42 on the bottom side near the back end. Adjacent to the contact points between the support tube 42 and support plates 44 are circular openings. Attached and perpendicular to the front ends of the support plates 44 is a hexagonal shaped plate 46. The hexagonal plate 46 is permanently affixed at contact points on the support plates 44. Attached to the front side of the hexagonal plate 46, near the outside edges of the hexagonal plate 46, are triangular-shaped teeth 48 which extend radially from the hexagonal plate 46.

An attachment bracket 52 fixedly attached near the bottom end of an actuator 50, which attachment bracket 52 contains a circular opening, is positioned between the support plates 44 with the circular openings in the attachment bracket 52 alining with the circular openings of the support plates 44. A pivot pin 54 is inserted into the circular openings allowing the actuator 50 to be rotatably attached to the support plates 44.

Top Assembly

Figure 2:
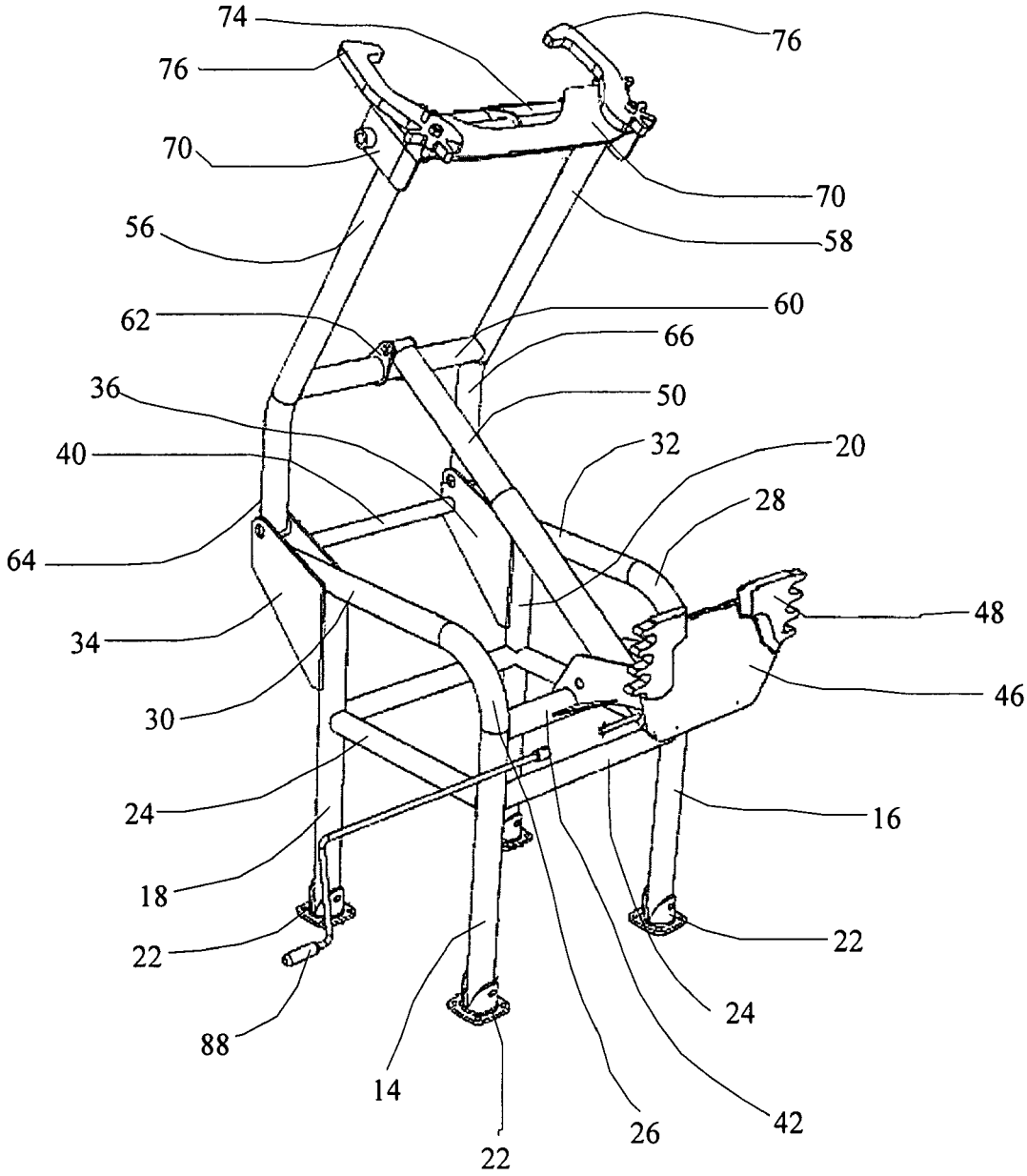
FIG. 2 is a perspective view of the diving board lift in an up position.

Referring to FIG. 1, 2, 3 and 6, the top assembly consists of a first lift tube 56 and a second lift tube 58 which first and second lift tubes 56, 58 have a front end and a back end. A cross-bracing tube 60 extends across and at right angles to the first and second lift tubes 56, 58. The cross-bracing tube 60 is permanently affixed at contact points near the back end of the first and second lift tubes 56, 58. Attached to the cross-bracing tube 60 are a pair of horizontal "A" shaped connectors 62 with each horizontal "A" shaped connector 62 containing a circular opening.

Attached to the back end of the first lift tube 56 is the first end of the first downward-curved tube section 64. Attached to the back end of the second lift tube 58 is the first end of the second downward-curved tube section 66. Attached to the second end of the first and second downward-curved tube sections 64, 66 are "T" connectors 68 with each "T" connector 68 containing a circular opening.

A rectangular shaped plate 70 is attached to the front ends of the first and second lift tubes 56, 58. The rectangular shaped plate 70 has a front side and two outside end sections which end sections are bent inward and at right angles to the front side. The end sections of the rectangular plate 70 are fixedly attached to the sides of the first and second lift tubes 56, 58. The end sections of the rectangular plate 70 each contain a circular opening. Maintained between the circular openings of the rectangular plate's 70 end sections are a pair of roller members 74. The roller members 74 are rotatably contained on a shaft 72. The ends of the shaft 72 are maintained within the circular openings of the rectangular plate's 70 end sections.

Rotatably attached to the rectangular plate's 70 front side are a pair of latch mechanisms 76 having a top end and a bottom end. The top ends of the latch mechanisms 76 contain inward extending horizontal latches and the bottom ends of the latch mechanisms 76 contain triangular-shaped teeth. The latch mechanisms 76 each contain a circular opening adjacent to the triangular shaped teeth which are aligned with circular openings on the front side of the rectangular plate 70. A torsion spring 78 and tubing section 80 are maintained between the latch mechanisms 76 and the rectangular plate's 70 front side. A bolt 82 passes through the latch mechanism 76, the tubing section 80, the torsion spring 78 and the front side of the rectangular plate 70 and secured in place with a nut.

The top assembly is rotatably attached to the bottom assembly by positioning the "T" connectors 68 of the downward-curved tube sections 64,66 within the flanges 38 of the triangular plates 34, 36 and aligning the circular openings. A pivot pin 84 is inserted into the circular openings. An actuator tube attachment 86, fixedly attached to the top end of the actuator 50, is positioned between the "A" shaped connectors 62 of the cross-bracing tube 60. The circular openings of the actuator tube attachment 86 and the "A" shaped connectors 62 are aligned and a pivot pin 84 inserted.

To utilize the lift, the apparatus must be placed under a diving board and properly attached to the flooring surface. When in its lowered position, the actuator 50 is retracted and the first and second lift tubes 56, 58 of the top assembly are parallel to the first and second horizontal tubing sections 30, 32 of the bottom assembly. The triangular-shaped teeth of the latch mechanisms 76 and the triangular-shaped teeth 48 attached to hexagonal plate 46 are intertwined with the inward extending horizontal latches of the latch mechanisms 76 maintained below the triangular-shaped teeth 48.

To raise the diving board, the crank stem 88 of the actuator 50 is rotated in a clockwise direction. As the crank stem 88 is rotated, the top assembly rotates about the pivot pins 54, 84 and the triangular-shaped teeth of the latch mechanisms 76 rotate about the triangular-shaped teeth 48 attached to hexagonal plate 46. The roller members 74 come into contact with the diving board and raise the diving board to a near vertical position. So as to ensure that the top assembly of the lift remains in proper position with the diving board, the inward extending horizontal latches of the latch mechanisms 76 are rotated to come into contact with the topside of the diving board.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is intended that the appended claims cover all such additions, modifications and rearrangements.

What is claimed is:

1. A diving board lift assembly for lifting a diving board from a substantially horizontal diving position to a substantially upright storage position, the diving board for use in connection with a swimming area, said diving board lift assembly comprising:

base castings;

a base assembly to support the top assembly lifting mechanism is comprised of:

a first, second, third and fourth vertically extending support posts having a top end and a bottom end with the bottom end of each support post maintained within a base casting;

cross-bracing tubes extend across and at right angles to the support posts which cross-bracing tubes are permanently affixed to the support posts;

attached to the top end of the first support post is a first inward-curved horizontal section of tubing and attached to the top end of the second support post is a second inward-curved horizontal section of tubing;

a pair of horizontal tubing sections are fixedly attached, at one end, to the first and second inward-curved sections of tubing and fixedly attached to the other end of the horizontal tubing sections are a pair of triangular plates;

a pair of flanges having circular openings are fixedly attached to the triangular plates;

a plate-bracing tube extends across and at right angles to the inside plates of the triangular plates to maintain the plates in the intended position;

a support tube between and fixedly attached to the first support post and the second support post;

a pair of support plates containing circular openings which support plates are fixedly attached and at right angles to the support tube;

attached and perpendicular to the front ends of the support plates is a hexagonal shaped plate;

attached to the hexagonal plate are triangular-shaped teeth which extend radially from the hexagonal plate;

a top assembly rotatably attached to the base assembly which top assembly raises and lowers the diving board is comprised of:

a first lift tube and a second lift tube with each lift tube having a front end and a back end;

a cross-bracing tube containing a pair of "A" shaped connectors which cross-bracing tube extends across and at right angles and is fixedly attached to the first and second lift tubes;

a first and a second downward-curved tube sections having a first end and a second end with the first end of the first downward-curved tube section attached to the back end of the first lift tube and the first end of the second downward-curved tube section attached to the back end of the second lift tube;

a pair of "T" connectors attached to the second end of the first and second downward-curved tube sections which "T" connectors contain circular openings which "T" connectors are rotatably maintained between the flanges of the base assembly;

a rectangular shaped plate attached to the front ends of the first and second lift tubes which rectangular shaped plate has a front side and two outside end sections which end sections are bent inward and at right angles to the front side with each end section containing a circular opening;

at least one roller member maintained between the circular openings of the rectangular plates which roller member is rotatably contained on a shaft;

a pair of latch mechanisms having a top end and a bottom end rotatably attached to the rectangular plates with the top ends of the latch mechanisms containing inward extending horizontal latches and the bottom ends of the latch mechanisms containing triangular-shaped teeth;

an actuator having a crank stem for raising and lowering the top assembly from the base assembly which actuator has a first end and a second end with the first end rotatably maintained between the "A" shaped connectors of the top assembly with a pivot pin and the second end rotatably maintained between the support plates of the base assembly with a pivot pin.

2. A diving board lift assembly for lifting a diving board from a substantially horizontal diving position to a substantially upright storage position, the diving board for use in connection with a swimming area, said diving board lift assembly comprising:

a base assembly comprised of:

a first, a second, a third and a fourth vertical support post;

base castings into which one end of the vertical support posts are inserted and maintained;

cross-bracing tubes which are maintained between the support posts;

inward-curved horizontal tubing sections fixedly attached to the first and second support posts;

a first and a second horizontal tubing section which horizontal tubing sections are fixedly attached to the inward-curved horizontal tubing sections;

a pair of triangular plates fixedly attached to the horizontal tubing section;

a pair of flanges having circular openings which flanges are fixedly attached to the triangular plates;

a plate-bracing tube extending across and fixedly attached to the triangular plates;

a support tube fixedly attached to and maintained between the first and second support posts;

a pair of support plates containing circular openings which support plates are fixedly attached to the support tube;

a hexagonal shaped plate which is attached and perpendicular to the support plates;

attached to the hexagonal plate are triangular-shaped teeth which extend radially from the hexagonal plate;

an attachment bracket;

a top assembly rotatably attached to the base assembly which top assembly is comprised of:

a first and a second lift tube with each tube having a front end and a back end;

a cross-bracing tube containing a pair of "A" shaped connectors which cross-bracing tube extends across and at right angles and is fixedly attached to the first and second lift tubes;

a first and a second downward-curved tube section having a first end and a second end with the first end of the first downward-curved tube section attached to the back end of the first lift tube and the first end of the second downward-curved tube section attached to the back end of the second lift tube;

a pair of "T" connectors attached to the second end of the first and second downward-curved tube sections which "T" connectors contain circular openings which "T" connectors are rotatably maintained between the flanges of the base assembly;

a rectangular shaped plate having a front side and two outside end sections which end sections are bent inward and at right angles to the front side with each end section containing a circular opening;

at least one roller member;

a shaft;

a pair of latch mechanisms having a top end and a bottom end with the top ends of the latch mechanisms containing inward extending horizontal latches and the bottom ends of the latch mechanisms containing triangular-shaped teeth;

an actuator having a crank stem for raising and lowering the top assembly from the base assembly which actuator has a first end and a second end with the first end rotatably maintained between the "A" shaped connectors of the top assembly with a pivot pin and the second end rotatably maintained between the support plates of the base assembly with a pivot pin;

to utilize the lift, the assembly must be placed under a diving board and properly attached to the flooring surface by attaching the base casters to the ground surface and maintained in its lowered position with the actuator retracted, the first and second lift tubes of the top assembly parallel to the first and second horizontal tubing sections of the base assembly, the triangular-shaped teeth of the latch mechanisms and the triangular-shaped teeth attached to hexagonal plate intertwined with the inward extending horizontal latches of the latch mechanisms maintained below the triangular-shaped teeth;

to raise a diving board, the crank stem of the actuator is rotated in a clockwise direction causing the top assembly to rotate about the pivot pins, the triangular-shaped teeth of the latch mechanisms to rotate about the triangular-shaped teeth attached to hexagonal plate, and the roller members to come into contact with the diving board and raise the diving board to a near vertical position with the horizontal latches of the latch mechanisms coming into contact with the topside of the diving board to maintain the diving board in the desired raised position.

3. The device of claim 2, wherein each support post extends vertically from the base castings which base castings are adapted to be fixed in position.

4. The device of claim 2, wherein the cross-bracing tubes of the base assembly extend across and at right angles to the support posts.

5. The device of claim 2, wherein attached to the top end of the first support post is the first inward-curved horizontal tubing section and attached to the top end of the second support post is the second inward-curved horizontal tubing section.

6. The device of claim 2, wherein the horizontal tubing sections of the base assembly are fixedly attached, at one end, to the first and second inward-curved tubing sections and fixedly attached at the opposing ends are the triangular plates.

7. The device of claim 2, wherein the flanges of the base assembly are fixedly attached to the triangular plates.

8. The device of claim 2, wherein the plate-bracing tube of the base assembly extends across and at right angles to the trinangular plates.

9. The device of claim 2, wherein the cross-bracing tube containing the "A" shaped connectors extends across and at right angles to the first and second lift tubes.

10. The device of claim 2, wherein the first downward-curved tube section is attached to the first lift tube and the second downward-curved tube section is attached to the second lift tube of the top assembly.

11. The device of claim 2, wherein the "T" connectors of the top assembly are attached to the first and second downward-curved tube sections.

12. The device of claim 2, wherein the roller member of the top assembly is maintained between the circular openings of the rectangular plates which roller member is rotatably contained on the shaft.

13. The device of claim 1, wherein to utilize the lift, the assembly must be placed under a diving board and properly attached to the flooring surface by attaching the base castings to the ground surface and maintained in its lowered position with the actuator retracted, the first and second lift tubes of the top assembly parallel to the first and second horizontal tubing sections of the base assembly, the triangular-shaped teeth of the latch mechanisms and the triangular-shaped teeth attached to hexagonal plate intertwined with the inward extending horizontal latches of the latch mechanisms maintained below the triangular-shaped teeth.

14. The device of claim 1, wherein to raise a diving board, the crank stem of the actuator is rotated in a clockwise direction causing the top assembly to rotate about the pivot pins, the triangular-shaped teeth of the latch mechanisms to rotate about the triangular-shaped teeth attached to hexagonal plate, and the roller members to come into contact with the diving board and raise the diving board to a near vertical position with the horizontal latches of the latch mechanisms coming into contact with the topside of the diving board to maintain the diving board in the desired raised position.

* * * * *